United States Patent [19]

Kmiec

[11] 4,354,680

[45] Oct. 19, 1982

[54] PINBALL GAME INCLUDING ELEVATED BALL PATHWAY

[75] Inventor: Gregory E. Kmiec, Chicago, Ill.

[73] Assignee: Bally Manufacturing Corporation, Chicago, Ill.

[21] Appl. No.: 201,756

[22] Filed: Oct. 29, 1980

[51] Int. Cl.[3] ..... A63F 7/00

[52] U.S. Cl. ..... 273/121 A; 273/DIG. 26

[58] Field of Search ..... 273/121 R, 124 R, 124 A, 273/177 A, 119 R, 119 A, 120 R, 120 A, 121 A, 122 R, 122 A, 125 A, DIG. 26

[56] References Cited

U.S. PATENT DOCUMENTS

| | | | |
|---|---|---|---|
| 2,058,202 | 10/1936 | Anderson | 273/121 R |
| 2,664,291 | 12/1953 | Petterson | 273/121 R |
| 3,074,722 | 1/1963 | Davenport | 273/177 A |

FOREIGN PATENT DOCUMENTS

| | | | |
|---|---|---|---|
| 1422335 | 11/1964 | France | 273/121 A |

*Primary Examiner*—George J. Marlo

*Attorney, Agent, or Firm*—Fitch, Even, Tabin, Flannery & Welsh

[57] ABSTRACT

A pinball machine having a novel play feature is disclosed. The play feature comprises a tubular member having an entrance and an exit and being downwardly inclined from the entrance to the exit so that gravitational forces will cause a ball entering the tubular member by the entrance to roll to the exit. The play feature further comprises an entrance ramp extending from the playfield to the entrance of the tubular member to allow a ball from the playfield to roll up into the tubular member. If desired, a plurality of lights may be located along the bottom of the tubular member and, in order to actuate the lights, a switching member may be provided at the entrance of the tubular member.

15 Claims, 2 Drawing Figures

PINBALL GAME INCLUDING ELEVATED BALL PATHWAY

This invention relates to pinball games and, more particularly, to a pinball machine containing a novel play feature.

The design of the playfield of a pinball machine is critical to the commercial success of the pinball machine. To this effect an appropriate combination of play features are desirable to produce a game with an appealing play. Generally, a pinball machine having a challenging but controlled game format, with other operating features such as multiple player play, compound or bonus scoring systems, and bonus ball replays, will be accepted and will be in great demand in the marketplace. However, because experienced players become rather selective in the pinball game apparatus on which they play, the owners and therefore the suppliers of such apparatus are constantly looking for new game formats and new play features to add to the pinball machine which hopefully will appeal to both players and owners. In the past play features have included any number of apparatus, such as roll over buttons, spinner lanes, flipper bumpers and drop targets.

Accordingly, it is an object of the present invention to provide a pinball machine containing a novel play feature.

Figure 1:
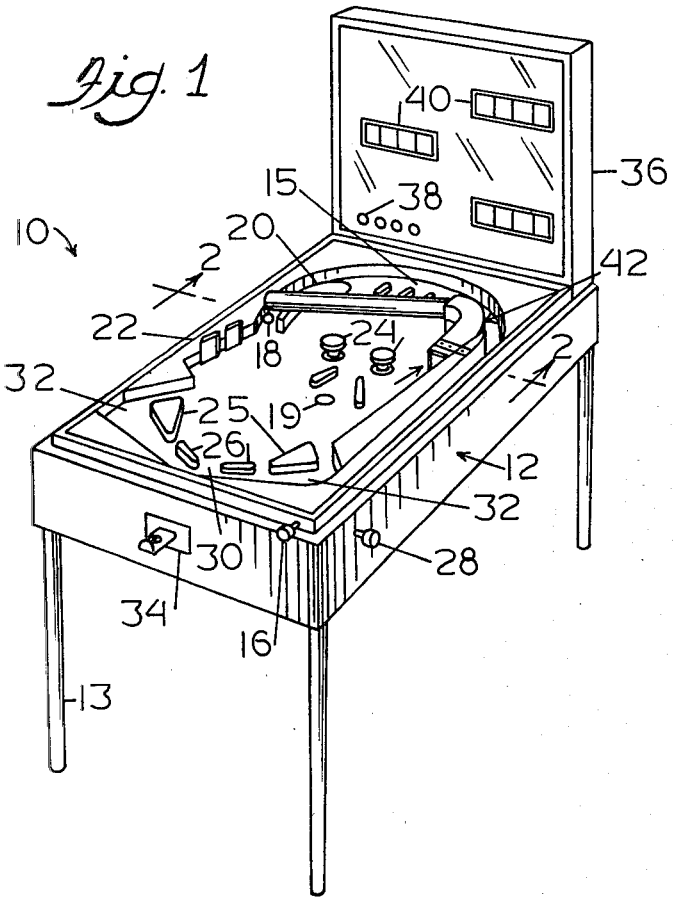
Figure 2:
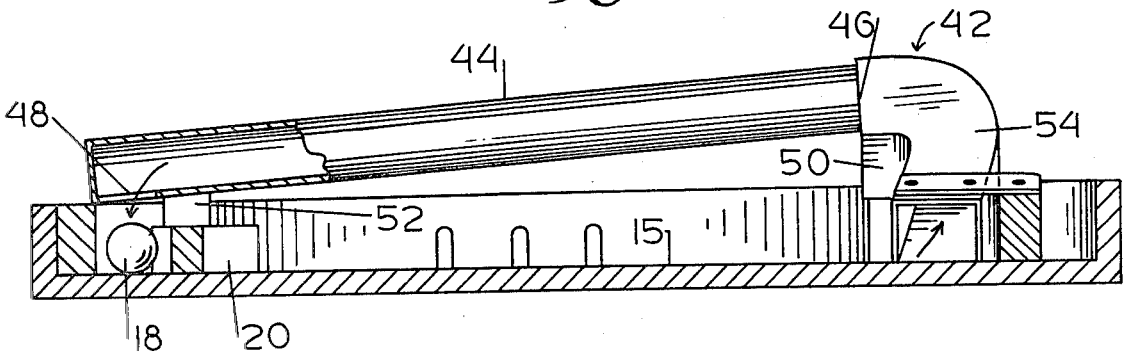

Other objects of the invention in addition to that set forth above will become apparent to those skilled in the art from the following description taken in connection with the accompanying drawings wherein:

FIG. 1 is a perspective view showing a pinball machine containing the device of the present invention; and FIG. 2 is a partially broken away sectional view taken generally along the line 2—2 in FIG. 1 showing the novel play feature of the pinball machine.

Broadly stated, the device of the present invention is a pinball machine comprising a downwardly inclined playfield, a ball, means for propelling the ball onto the playfield, one or more pivotally mounted flippers disposed near the playfield for affecting motion of the ball, and a novel play feature. The play feature comprises a tubular member having an entrance and an exit, with the tubular member disposed above the playfield and being downwardly inclined from the entrance to the exit so that gravitational forces will cause a ball entering the tubular member by the entrance to roll to the exit. The play feature further comprises an entrance ramp extending from the playfield to the entrance of the tubular member to allow a ball from the playfield to roll up into the tubular member.

Referring more specifically to FIG. 1, the illustrated pinball machine 10 includes an upper cabinet 12 supported on legs 13 approximately at waist height to the usual game player. The cabinet 12 has a glass top beneath which is located a slightly inclined bordered playfield 15. A manual ball feeding mechanism 16 is located at the lower right-hand corner of the playfield and is used for ejecting a round ball 18 to the upper end of the playfield 15 at the start of play. The ball then rolls under the influence of gravity downwardly over the slightly inclined playfield against and past the various ball directing and target means located on the playfield. In the illustrated apparatus, some ball directing and target means shown include kick out holes 19, upper guide rails 20, spaced drop targets 22, thumper bumpers 24, and slingshot kicker 25. Additionally, flippers 26 selectively controlled by manual left and right actuators 28 straddle a central out of play lane 30. A pair of side out of play lanes 32 are also defined on the sides of the playfield. In the typical game, once the ball passes through an out of play lane, it is lost; and either a subsequent ball is then available to be put into play or the game is over. A coin mechanism 34 is located on the front of the cabinet to accept coins in the proper amount to enable play for the number of players desired. A back cabinet 36 is typically also provided, being glass covered and having suitable decorative and game operation material thereon. Thus, player indicating means 38 advises visually which player is playing, and the players' score area 40 provides continuous updated scores in digital display for the respective players. Other indicators can include a tilt notice, ball in play indicators and flashing score related lights not specifically identified.

The game apparatus may vary widely with respect to the particulars of the scoring as the ball moves about the playfield and against the various ball directing means and/or target means. Basically, however, each ball directing or target means, upon being hit by the ball, either redirects the ball, adds to the score of the player, or a combination of both. A control disclosed in the Nutting et al. U.S. Pat. No. 4,093,232 or in the Bracha et al. U.S. Pat. No. 4,198,051, both of which are incorporated herein by reference, can be provided for totaling the score and for illuminating the lights, according to some prearranged logic of the game apparatus as the ball caroms about the playfield.

In accordance with the present invention a play feature 42 is shown disposed above the playfield 15. As can be seen most clearly in FIG. 2, the play feature 42 comprises preferrably a transparent cylindrically shaped tubular member 44 having an entrance 46 and exit 48. The tubular member 44 is securely supported above the playfield 15 on one side by support 50 and on the other side by support 52 so that it is downwardly inclined from the entrance 46 to the exit 48 of the tubular member 44. The angle that the tubular member 44 is downwardly inclined must be sufficient to insure that a ball which enters the tubular member 44 by the entrance 46 will always, under the influence of gravity, roll toward the exit 48 thereby preventing the ball from being stuck in the tubular member 44.

An entrance ramp 54 is provided which extends from the surface of the playfield 15 to the entrance 46 of the tubular member 44 for allowing a ball to be propelled from the playfield, up the ramp 54 and into the interior of the tubular member 44 through the entrance 46.

All portions of the tubular member 44 which are disposed above sections of the playfield 15 where the ball can roll are supported sufficiently above the surface of the playfield 15 so that a ball 18 can roll unobstructedly under the tubular member 44.

The exit 48 of the tubular member 44 is a hole cut into the bottom of the tube 44 of sufficient diameter to allow a ball to drop unobstructedly from the tubular member 44 onto the playfield 15.

Although the ball carrying member is shown as a tubular member, the invention is intended to encompass any suitable ball carrying member which defines a path above the playfield. Also, although in the disclosed embodiment the tubular member is downwardly tilted from the entrance to the exit, this need not be done if means are provided for propelling the pinball from the entrance to the exit of the tubular member.

According to a further aspect of the present invention there can be a plurality of lights extending along the bottom of the tubular member 44 which can be, for example, illuminated in sequence every time a pinball enters the tubular member 44. This would require a switching member at the entrance of the tubular member 44 or disposed along the ramp 54 for actuation of the lights. Further, the lights and the wires to connect the lights to the control circuit for the pinball machine can be disposed in a tubular portion which runs along the outside bottom of the tubular member 44.

From the foregoing it should be appreciated that a pinball machine having a novel play feature has been described which enhances the player appeal of the pinball machine.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

Various features of the invention are set forth in the following claims.

What is claimed is:

1. A pinball machine comprising:

a downwardly inclined playfield;

a ball;

means for propelling the ball onto the playfield;

one or more pivotally mounted flippers disposed near the playfield for affecting motion of the ball; and a play feature comprising a ball carrying member defining a path along which the ball rolls, the ball carrying member being constructed so that a ball rolling along the path must travel generally along a predetermined line, the ball carrying member having an entrance and an exit and being disposed so that the path is located above the playfield, the play feature being disposed so that a ball rolling along the playfield can pass under a portion of the path without coming in contact with the play feature, means for transferring a ball in play from the playfield to the entrance of the ball carrying member, and means for moving a ball from the entrance of the ball carrying member, along the path and out the exit of the ball carrying member back onto the playfield.

2. The pinball machine of claim 1 wherein the transferring means comprise an entrance ramp extending from the playfield to the entrance of the ball carrying member to allow a ball in play to roll from the playfield up into the ball carrying member.

3. The pinball machine of claim 1 wherein the moving means comprises means for supporting the ball carrying member above the playfield so that the path is downwardly inclined from the entrance to the exit of the ball carrying member, whereby gravitational forces will cause a ball entering the ball carrying member from the entrance to roll along the path to the exit.

4. The pinball machine of claim 1 wherein the ball carrying member comprises a tubular member within which the ball rolls.

5. The pinball machine of claim 4 wherein a portion of the tubular member where the ball rolls is made of a transparent material so that a portion of the playfield is visible through the tubular member.

6. The pinball machine of claim 4 or 5 wherein the tubular member is cylindrical.

7. The pinball machine of claim 5 or 6 wherein the tubular member is made of a transparent material.

8. A play feature for use with a pinball machine having a playfield comprising:

a ball carrying member defining a path over which a ball rolls, the ball carrying member being constructed so that a ball rolling along the path must travel generally along a predetermined line, the ball carrying member having an entrance and an exit, and being disposed above the playfield, the playfeature being disposed so that a ball rolling along the playfield can pass under a portion of the path without coming in contact with the playfeature;

means for transferring a ball in play from the playfield to the entrance of the ball carrying member; and means for moving a ball from the entrance of the ball carrying member, along the path and out the exit of the ball carrying member back onto the playfield.

9. The play feature of claim 8 wherein the transferring means comprise an entrance ramp extending from the playfield to the entrance of the ball carrying member to allow a ball in play to roll from the playfield up into the ball carrying member.

10. The play feature of claim 8 wherein the moving means comprises means for supporting the ball carrying member above the playfield so that the path is downwardly inclined from the entrance to the exit of the ball carrying member, whereby gravitational forces will cause a ball entering the ball carrying member from the entrance to roll along the path to the exit.

11. The play feature of claim 8 wherein the ball carrying member comprises a tubular member within which the ball rolls.

12. The play feature of claim 11 wherein a portion of the tubular member where the ball rolls is made of a transparent material so that a portion of the playfield is visible through the tubular member.

13. The playfeature of claim 11 or 12 wherein the tubular member is cylindrical.

14. The playfeature of claim 12 wherein the tubular member is made of a transparent material.

15. The playfeature of claim 13 wherein the tubular member is made of a transparent material.

* * * * *